US007263735B2

(12) United States Patent
Son

(10) Patent No.: US 7,263,735 B2
(45) Date of Patent: Sep. 4, 2007

(54) WASHING MACHINE CONTROL METHOD AND WASHING MACHINE USING THE SAME

(75) Inventor: Kweon Son, Changwon-si (KR)

(73) Assignee: LG Electronics Inc., Seoul (KR)

( * ) Notice: Subject to any disclaimer, the term of this patent is extended or adjusted under 35 U.S.C. 154(b) by 522 days.

(21) Appl. No.: 10/717,635

(22) Filed: Nov. 21, 2003

(65) Prior Publication Data

US 2004/0098813 A1 May 27, 2004

(30) Foreign Application Priority Data

Nov. 25, 2002 (KR) ..... 10-2002-0073605

(51) Int. Cl.

| | |
|---|---|
| ***D06F 35/00*** | (2006.01) |
| ***D06F 39/00*** | (2006.01) |
| ***D06F 29/00*** | (2006.01) |
| ***D06F 21/04*** | (2006.01) |
| ***D06F 21/00*** | (2006.01) |
| ***D06F 23/00*** | (2006.01) |
| ***D06F 25/00*** | (2006.01) |
| ***D06F 33/00*** | (2006.01) |
| ***D06F 39/02*** | (2006.01) |
| ***D06F 49/00*** | (2006.01) |
| ***D06F 51/00*** | (2006.01) |
| ***B08B 9/00*** | (2006.01) |
| ***B08B 1/02*** | (2006.01) |
| ***B08B 7/00*** | (2006.01) |

(52) U.S. Cl. ..... 8/159; 8/158; 68/23.1; 68/24; 68/58; 68/140; 68/12.12; 68/12.14; 134/23; 134/32; 134/33

(58) Field of Classification Search ..... 8/158, 8/159; 134/32, 33, 23; 68/23.1, 12.12, 12.14, 68/24, 58, 140

See application file for complete search history.

(56) References Cited

U.S. PATENT DOCUMENTS 6,401,284 B1 * 6/2002 Jeon et al. ..... 8/158
7,059,002 B2 * 6/2006 Lee et al. ..... 8/158

* cited by examiner

*Primary Examiner*—Michael Barr
*Assistant Examiner*—Rita R Patel
(74) *Attorney, Agent, or Firm*—McKenna Long & Aldridge LLP

(57) ABSTRACT

A washing machine control method includes executing a dewatering step. The method accelerates a motor to rotate a drum according to a predetermined rate in response to the dewatering execution step. The method detects if the predetermined rate exceeds a first value but is less than a second value, and whether a state of vibration exists with respect to the drum rotated according to the predetermined rate; and stops the motor if the detected state of vibration exists.

8 Claims, 3 Drawing Sheets

WASHING MACHINE CONTROL METHOD AND WASHING MACHINE USING THE SAME

This application claims the benefit of Korean Application No. 10-2002-0073605 filed on Nov. 25, 2002, which is hereby incorporated by reference.

BACKGROUND OF THE INVENTION

1. Field of the Invention

The present invention relates to a washing machine, and more particularly, to washing machine having an apparatus for controlling a dewatering step, in which a vibration detector is utilized to avoid a re-initialization of a dewatering step due to a resonance vibration.

2. Discussion of the Related Art

In the dewatering step of a washing machine, which typically requires high-rate rotation (spinning) of a drum, eccentricity is an important issue. Eccentricity is usually caused by an asymmetrical distribution of laundry within the drum, which is being rotated by a motor, and excessive eccentricity will generate undue levels of vibration and noise. Therefore, eccentricity must be carefully monitored so the motor speed, typically measured in revolutions per minute (rpm), may be regulated to control the rotational speed of the dewatering step. For excessive amounts of eccentricity, the motor is stopped.

An apparatus for controlling a dewatering step in a washing machine according to a related art, as shown in FIG. 1, includes a motor 1, an eccentricity detector 2 for detecting an amount of eccentricity present during the execution of a dewatering step, and a microcomputer 3 for controlling the motor 1 and specifically for stopping the motor if the detected amount of eccentricity exceeds a predetermined level. The microcomputer 3 is provided with an internal memory (not shown), in which a lookup table is stored.

In the operation of the above apparatus, upon executing a dewatering step in the washing machine according to the related art, the microcomputer 3 controls the motor 1 to be accelerated to a predetermined rate or rpm, which is gradually increased until reaching the desired dewatering speed. When the motor 1 reaches the predetermined rate, an amount of eccentricity is detected by the eccentricity detector 2, which takes the measure of the motor's rpm at intervals according to a detection control signal of the microcomputer 3, to thereby detect rpm variations. The periodically detected results are fed to the microcomputer 3 as an arbitrary number representing eccentricity for comparison with the data of the lookup table. The microcomputer 3 thus determines whether rpm variation is within a predetermined allowable range of eccentricity and outputs a motor control signal to the motor 1 based on the determination, thereby stopping the motor if the amount of eccentricity exceeds the predetermined allowable range or otherwise further accelerating the motor. Assuming that amount of eccentricity continues to fall within the predetermined range as the eccentricity detection is repeated periodically according to a predetermined cycle, further accelerations will cause the motor 1 to reach a desired dewatering speed as determined by user operation.

The lookup table of the microcomputer 3 includes data for an allowable range of eccentricity (reference eccentricity), desired dewatering speed, and a number n of periodic eccentricity detections. Importantly, the allowable range of eccentricity and the dewatering speed both vary in steps as the periodic eccentricity detection number progresses, with the reference eccentricity allowing for greater amounts of eccentricity for slower dewatering speeds. An example of such a lookup table is shown in Table 1 below.

TABLE 1

| eccentricity detection number (n) | 1~5 | 6~10 | 10~15 | 16~20 |
|---|---|---|---|---|
| reference eccentricity | 20 | 25 | 30 | 35 |
| desired dewatering speed (rpm) | 1200 | 1100 | 1000 | 800 |

Referring to FIG. 2, illustrating a washing machine control method according to a related art, the microcomputer 3 accelerates the motor 1 to a predetermined dewatering speed (rpm) in a step S1, and according to the microcomputer's detection control signal, the eccentricity detector 2 periodically detects in a step S2 the dewatering speed as the motor is accelerated. The predetermined rate of the motor 1 for the initial detection of eccentricity is, for example, 100 rpm, which is the n=1 condition. The eccentricity detection number n is incremented in a step S3 and continues to be incremented until the desired dewatering speed is reached.

In a step S4, it is determined whether the detected eccentricity at the accelerated motor speed corresponding to eccentricity detection n is acceptable with respect to the reference eccentricity of Table 1. If so, the acceleration rate of the motor 1 is controlled in a step S5, gradually increasing to the desired dewatering speed while incrementing the eccentricity detection number. Initially, the eccentricity detection number is "1" so that the reference eccentricity is "20" and the desired dewatering speed is 1200 rpm.

On the other hand, if it is determined that the detected eccentricity exceeds the reference eccentricity, the motor 1 is stopped in a step S6 and the dewatering step is reinitialized. In doing so, the rotational rate of the motor 1 decelerates as necessary and the eccentricity number is reset to "1."

The above washing machine according to the related art, however, has a significant problem with resonance vibration, which is an inherent problem in dewatering washing machines. As the dewatering step progresses, a resonance vibration occurring at motor rates of about 150~300 rpm naturally interferes with the rate of eccentricity detection, regardless of dewatering speed control. In addition to undesired levels of noise, the resonance vibration produces eccentricity, such that the reference eccentricity values of the lookup table must be set low, which repeatedly interrupts the acceleration of the motor and thus impedes dewatering and increases washing time accordingly.

SUMMARY OF THE INVENTION

Accordingly, the present invention is directed to a washing machine control method, and a washing machine using the same, that substantially obviates one or more of the problems due to limitations and disadvantages of the related art.

An object of the present invention, which has been devised to solve the foregoing problem, lies in providing a washing machine control method, and a washing machine using the same, by which the performance of a dewatering step is unimpeded and vibration and noise are prevented.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a washing machine control method. The method comprises steps of executing a dewatering step; accelerating a motor to rotate a drum, according to a predetermined rate, in response to the dewatering execution step; detecting, if the predetermined rate exceeds a first value but is less than a second value, whether a state of vibration exists with respect to the drum rotated according to the predetermined rate; and stopping the motor if the detected state of vibration exists. The method preferably includes steps of detecting an eccentricity value with respect to the drum rotated according to the predetermined rate; and comparing the detected eccentricity value to a reference eccentricity value stored in a lookup table.

In another aspect of the present invention, there is provided a washing machine comprising a motor to rotate a drum according to a predetermined rate; means for detecting whether a state of vibration exists with respect to the rotating drum; and a microcomputer having a lookup table, coupled to the vibration state detection means, for controlling the predetermined rate of the motor and for stopping the motor if the detected eccentricity value exceeds a reference eccentricity value stored in the lookup table or if the detected state of vibration exists. The washing machine preferably includes means, coupled to the microcomputer, for detecting eccentricity value with respect to the rotating drum so that the motor may be also stopped if the detected eccentricity value exceeds a reference eccentricity value stored in the lookup table.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

Figure 3:
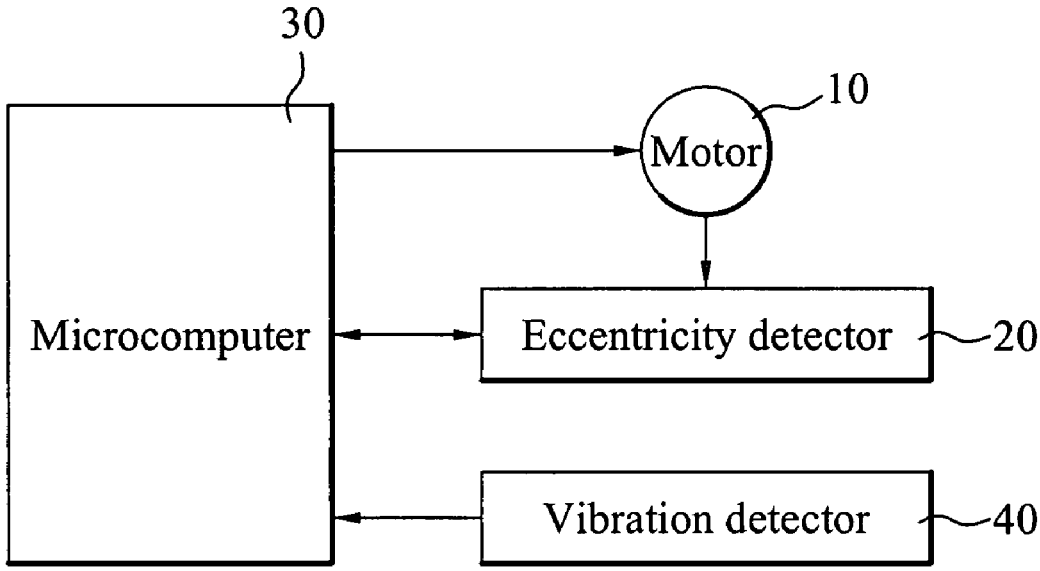
FIG. 3 is a block diagram of an apparatus for controlling a dewatering step in a washing machine according to the present invention.

Referring to FIG. 3, an apparatus for controlling a dewatering step in a washing machine according to the present invention includes a motor 10 for rotating a drum (not shown), an eccentricity detector 20 for detecting an amount of eccentricity on executing a dewatering step, a vibration detector 40 for detecting vibration on executing the dewatering step, and a microcomputer 30 for controlling the motor and specifically for stopping the motor if the detected eccentricity exceeds a predetermined level or if excessive vibration is detected. The eccentricity detector 20 is a conventional device and is controlled according to conventional means. The microcomputer 3 is provided with an internal memory (not shown), in which a lookup table is stored, which includes data setting the values of an allowable range of eccentricity (reference eccentricity), desired dewatering speed, and a number n of periodic eccentricity detections. An example of the lookup table is shown in Table 2 below.

TABLE 2

| eccentricity detection number (n) | 1~5 | 6~10 | 10~15 | 16~20 |
|---|---|---|---|---|
| reference eccentricity | 30 | 35 | 40 | 45 |
| desired dewatering speed (rpm) | 1200 | 1100 | 1000 | 800 |

Importantly, the reference eccentricity for a given eccentricity detection numbers of the present invention is greater than that of the related art and is set irrespective of any resonance vibration generated.

Figure 1:
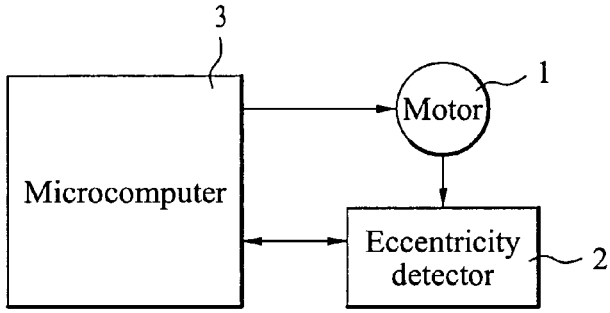
FIG. 1 Related Art
FIG. 1 is a block diagram of an apparatus for controlling a dewatering step in a washing machine according to a related art.
Figure 2:
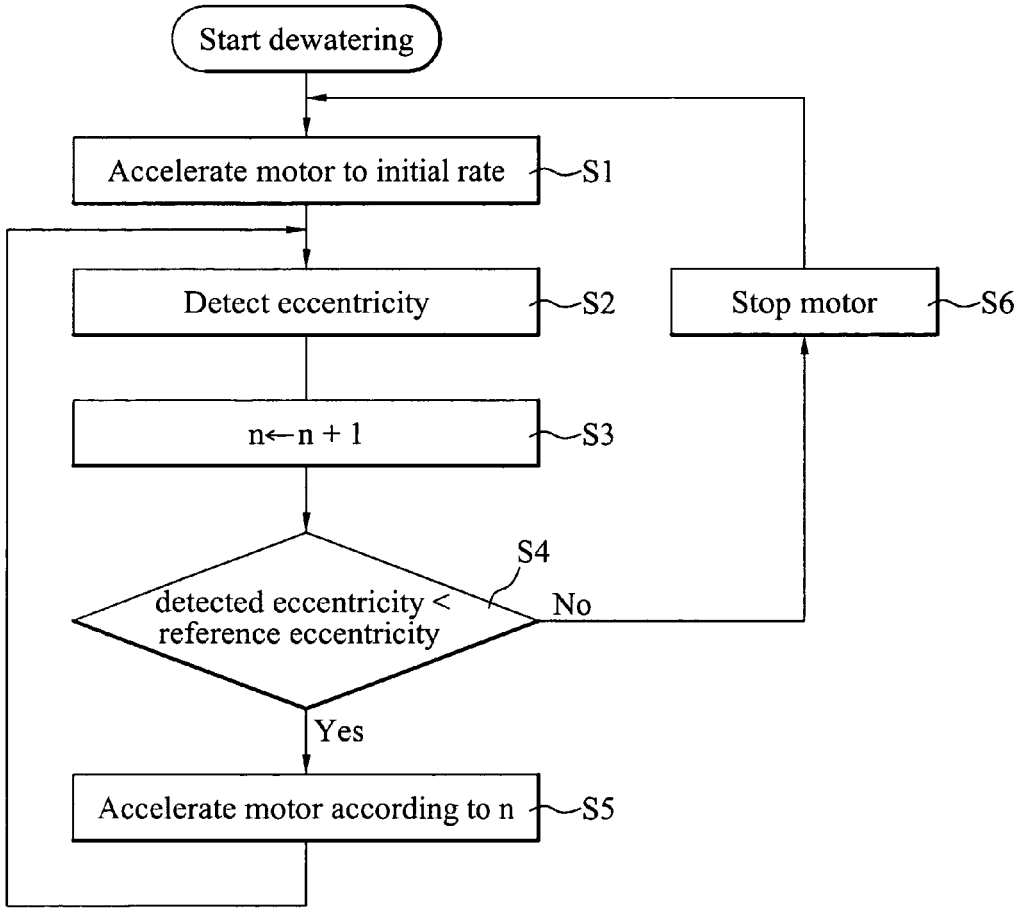
FIG. 2 Related Art
FIG. 2 is a flowchart of a method of controlling a dewatering step in a washing machine according to a related art.

In the operation of the above washing machine according to the present invention, the microcomputer 30 controls the motor 10 to accelerate to a dewatering speed according to a predetermined rate (rpm), i.e., 100 rpm, when a dewatering step is initiated. Meanwhile, the microcomputer 30 also outputs a detection control signal to the eccentricity detector 20, controlling the rate of eccentricity detection for a given dewatering speed as in the case of the related art as discussed with respect to FIGS. 1 and 2. If the detected eccentricity is within the limits of the reference eccentricity in the lookup table, the microcomputer 30 controls the motor 10 according to the desired dewatering speed but stops the motor if the detected eccentricity exceeds the reference eccentricity. For example, if vibration is detected through the vibration detector 40 as the dewatering speed reaches 150~300 rpm, whereupon resonance is generated, the microcomputer 30 stops the motor 10. Otherwise, the microcomputer 30 continues to accelerate the motor 10 gradually until reaching the desired dewatering speed.

Figure 4:
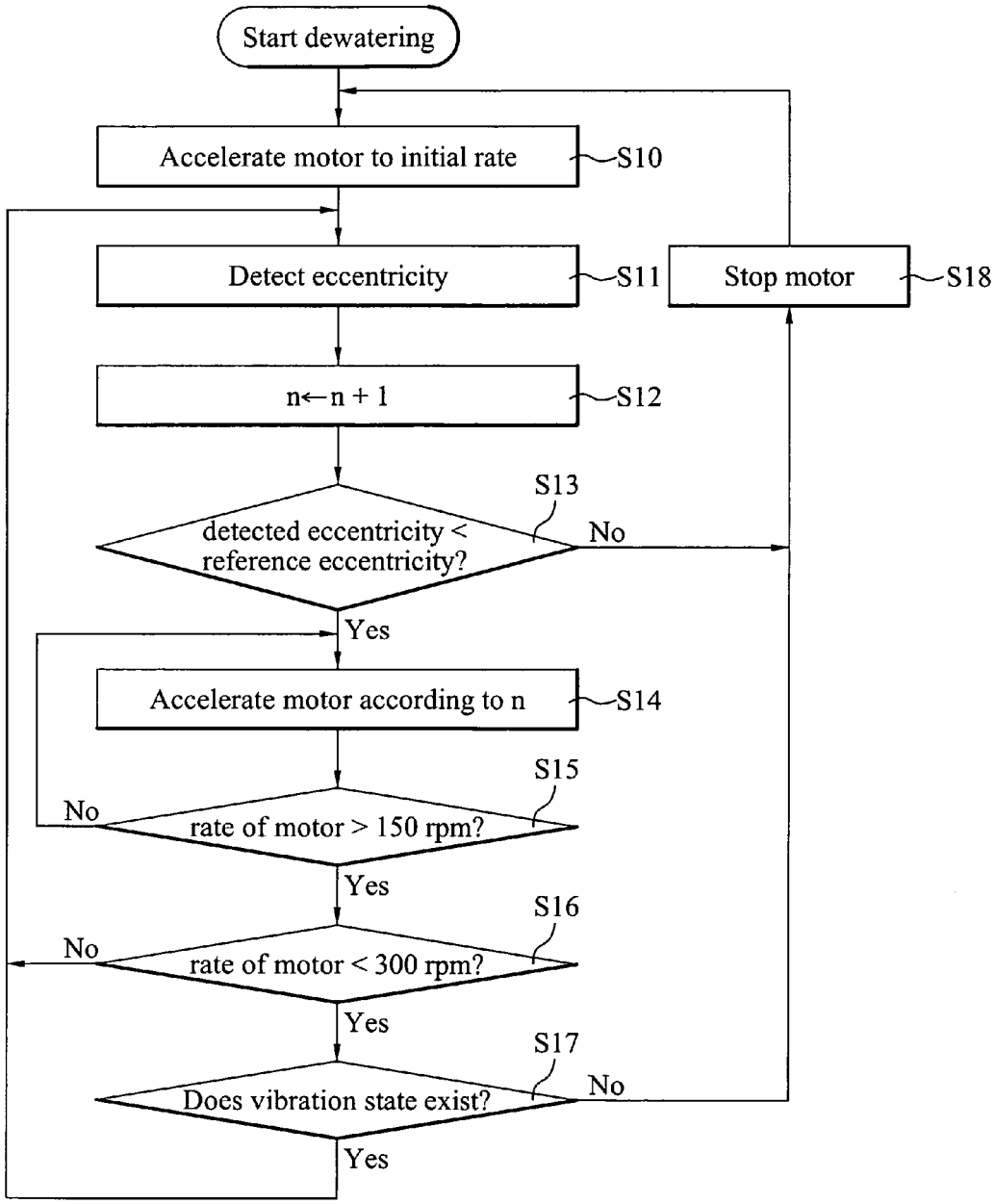
FIG. 4 is a flowchart of a method of controlling a dewatering step in a washing machine according to the present invention.

Referring to FIG. 4, illustrating a washing machine control method according to the present invention, the microcomputer 30 accelerates the motor 10 to a predetermined dewatering speed (rpm) in a step S10, and according to the microcomputer's detection control signal, the eccentricity detector 20 periodically detects in a step S11 the dewatering speed as the motor is accelerated. The predetermined rate of the motor 10 for the initial detection of eccentricity is, for example, 100 rpm, which is the n=1 condition. The eccentricity detection number n is incremented in a step S12 and continues to be incremented until the desired dewatering speed is reached.

In a step S13, it is determined whether the detected eccentricity at the accelerated motor speed corresponding to eccentricity detection n is acceptable with respect to the reference eccentricity of Table 2. If so, the acceleration rate of the motor 10 is controlled in a step S14, gradually increasing to the desired dewatering speed while incrementing the eccentricity detection number but otherwise stopping the motor 10 in a step S18. Initially, the eccentricity detection number is "1" so that the reference eccentricity is 30 and the desired dewatering speed is 1200 rpm.

As the dewatering speed increases, it is determined in a step S15 whether the current rotational rate of the motor 10 exceeds 150 rpm. If not, acceleration continues according to an execution of the step S14. Upon reaching 150 rpm, it is determined in a step S16 whether the current rotational rate of the motor 10 is still less than 300 rpm. If so, it is determined in a step S17 whether a state of excessive vibration exists. In other words, vibration is detected for dewatering speeds between 150 and 300 rpm, a range that may be adjusted according to resonance factors such as the washing machine model.

If no excessive vibration is detected in the step S17, eccentricity is detected for the incremented eccentricity detection number according to the steps S11 and S12 and acceleration of the motor 10 continues by the execution of the step S14 until the dewatering speed reaches the desired speed. On the other hand, if it is determined in the step S17 that excessive vibration is present, the motor 10 is stopped in the step S18.

As above, the present invention is provided with a means for detecting resonance vibration on dewatering, rendering unnecessary a consideration of the resonance vibration of a washing machine when setting up the lookup table. Hence, the present invention enables the setting of higher reference eccentricity values, thereby enabling unimpeded dewatering and reduced noise.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A washing machine control method, comprising steps of:

executing a dewatering step;

accelerating a motor to rotate a drum, according to a predetermined rate, in response to said dewatering execution step;

detecting, if the predetermined rate exceeds a first value but is less than a second value, whether a state of vibration exists with respect to the drum rotated according to the predetermined rate; and stopping the motor if the detected state of vibration exists.

2. The method as claimed in claim 1, wherein said accelerating step is repeated until a desired dewatering speed is reached.

3. The method as claimed in claim 1, further comprising a step of stopping the motor if the detected eccentricity value exceeds a the reference eccentricity value.

4. The method as claimed in claim 1, further comprising a step of incrementing the predetermined rate if it is determined that no state of vibration exists with respect to the drum rotated according to the predetermined rate.

5. The method as claimed in claim 4, wherein the predetermined rate is incremented according to predetermined values stored in a lookup table.

6. The method as claimed in claim 1, further comprising a step of:

detecting an eccentricity value with respect to the drum rotated according to the predetermined rate; and comparing the detected eccentricity value to a reference eccentricity value stored in a lookup table.

7. The method as claimed in claim 6, further comprising a step of incrementing the predetermined rate if it is determined that the detected eccentricity value is less than the reference eccentricity value and that no state of vibration exists with respect to the drum rotated according to the predetermined rate.

8. The method as claimed in claim 2, wherein the first value of the predetermined rate is 150 rpm and the second value of the predetermined rate is 300 rpm.

* * * * *